US007722478B2

(12) United States Patent
Ebner

(10) Patent No.: US 7,722,478 B2
(45) Date of Patent: May 25, 2010

(54) GOLF CLUB HEAD AND GOLF CLUB

(76) Inventor: Josef Ebner, Gutenhof 21, Top 1, A-2325 Himberg (AT)

( * ) Notice: Subject to any disclaimer, the term of this patent is extended or adjusted under 35 U.S.C. 154(b) by 74 days.

(21) Appl. No.: 11/840,469

(22) Filed: Aug. 17, 2007

(65) Prior Publication Data

US 2008/0051214 A1 Feb. 28, 2008

(30) Foreign Application Priority Data

Aug. 23, 2006 (AT) ..... 1408/2006

(51) Int. Cl.
*A63B 53/04* (2006.01)
*A63B 53/06* (2006.01)

(52) U.S. Cl. ..... 473/335; 473/340

(58) Field of Classification Search ..... 473/324–350
See application file for complete search history.

(56) References Cited

U.S. PATENT DOCUMENTS

D232,371 S * 8/1974 Becker ..... D21/741
D234,962 S * 4/1975 Swash ..... D21/739
D235,668 S * 7/1975 Swash ..... D21/739
4,010,958 A * 3/1977 Long ..... 473/341
4,121,833 A * 10/1978 Prueter ..... 473/330
4,650,191 A * 3/1987 Mills ..... 473/341
4,898,387 A * 2/1990 Finney ..... 473/341
4,979,744 A * 12/1990 Alcala ..... 473/341
5,080,365 A * 1/1992 Winchell ..... 473/255
5,160,141 A * 11/1992 Crews ..... 473/313
5,211,401 A * 5/1993 Hainey ..... 473/340
5,253,869 A 10/1993 Dingle et al.
5,409,219 A * 4/1995 Saksun, Sr. ..... 473/305
5,489,097 A 2/1996 Simmons
5,529,302 A * 6/1996 Rodriguez ..... 473/251
5,547,427 A * 8/1996 Rigal et al. ..... 473/345
5,580,058 A * 12/1996 Coughlin ..... 273/250
5,630,765 A * 5/1997 Moore ..... 473/252
5,645,493 A * 7/1997 Garcia ..... 473/203
5,676,606 A * 10/1997 Schaeffer et al. ..... 473/340
5,692,968 A * 12/1997 Shine ..... 473/286
5,709,613 A * 1/1998 Sheraw ..... 473/248
5,716,290 A * 2/1998 Baker et al. ..... 473/313
5,759,115 A * 6/1998 Spoerl ..... 473/349
5,769,736 A * 6/1998 Sato ..... 473/335
5,820,481 A * 10/1998 Raudman ..... 473/313
5,830,078 A * 11/1998 McMahan ..... 473/252
5,947,841 A * 9/1999 Silvestro ..... 473/341
5,993,324 A * 11/1999 Gammil ..... 473/251
6,019,686 A * 2/2000 Gray ..... 473/313

(Continued)

FOREIGN PATENT DOCUMENTS

JP 01043278 A * 2/1989

*Primary Examiner*—Alvin A Hunter
(74) *Attorney, Agent, or Firm*—Ostrolenk Faber LLP

(57) ABSTRACT

A golf club head, in particular a golf putter head, with a striking face, which is provided on the front side of a striking part, for a golf ball, and with a device, which is fastened to the rear side of the striking part, for receiving interchangeable weights. The device has two elements which mutually intersect preferably without any contact and to the one free end sections of which weights can be fitted. As a result, a shifting of the center of gravity and distribution of the weight of the head are possible in a particularly variable manner.

14 Claims, 1 Drawing Sheet

U.S. PATENT DOCUMENTS 6,267,689 B1 * 7/2001 Ambrose ..... 473/251
6,270,422 B1 * 8/2001 Fisher ..... 473/223
6,350,208 B1 * 2/2002 Ford ..... 473/249
6,394,910 B1 * 5/2002 McCarthy ..... 473/251
6,402,638 B1 * 6/2002 Kelley ..... 473/330
D460,990 S * 7/2002 Jung ..... D21/736
6,428,423 B1 * 8/2002 Merko ..... 473/307
6,558,271 B1 * 5/2003 Beach et al. ..... 473/327
6,634,956 B1 * 10/2003 Pegg ..... 473/251
6,652,390 B2 * 11/2003 Bradford ..... 473/341
6,663,497 B2 * 12/2003 Cameron ..... 473/245
6,796,911 B2 * 9/2004 Grace ..... 473/251
6,837,801 B1 * 1/2005 Souza et al. ..... 473/251
6,896,625 B2 * 5/2005 Grace ..... 473/251
6,899,636 B2 * 5/2005 Finn ..... 473/313
6,916,252 B2 * 7/2005 Bennett ..... 473/341
6,926,615 B1 * 8/2005 Souza et al. ..... 473/251
6,929,559 B1 * 8/2005 Grace ..... 473/251
6,929,564 B2 * 8/2005 Olsavsky et al. ..... 473/340
6,960,140 B2 * 11/2005 Solheim et al. ..... 473/251
6,966,845 B2 * 11/2005 Solheim et al. ..... 473/251
6,974,394 B1 * 12/2005 Tang et al. ..... 473/335
6,988,956 B2 * 1/2006 Cover et al. ..... 473/244
6,988,959 B2 * 1/2006 Pollman ..... 473/313
6,991,555 B2 * 1/2006 Reese ..... 473/251
7,004,849 B2 * 2/2006 Cameron ..... 473/249
7,018,304 B2 * 3/2006 Bradford ..... 473/334
7,048,639 B2 * 5/2006 Grace ..... 473/251
7,048,646 B2 * 5/2006 Yamanaka et al. ..... 473/332
7,077,758 B2 * 7/2006 Rohrer ..... 473/251
7,147,569 B2 * 12/2006 Tang et al. ..... 473/249
7,160,203 B2 * 1/2007 Bonneau ..... 473/334
7,163,469 B2 * 1/2007 Bonneau ..... 473/334
7,326,121 B2 * 2/2008 Roake ..... 473/251
7,347,793 B2 * 3/2008 Davis ..... 473/305
7,351,161 B2 * 4/2008 Beach ..... 473/334
7,351,162 B2 * 4/2008 Soracco et al. ..... 473/335
7,374,497 B2 * 5/2008 Brown ..... 473/251
7,390,267 B2 * 6/2008 Grace ..... 473/251
7,396,289 B2 * 7/2008 Soracco et al. ..... 473/251
7,396,295 B1 * 7/2008 Frame et al. ..... 473/337
7,407,443 B2 * 8/2008 Franklin et al. ..... 473/251
7,431,660 B2 * 10/2008 Hasegawa ..... 473/251
7,431,663 B2 * 10/2008 Pamias ..... 473/288
7,491,131 B2 * 2/2009 Vinton ..... 473/251
2004/0138003 A1 * 7/2004 Grace ..... 473/334
2005/0261080 A1 11/2005 Bradford

* cited by examiner

GOLF CLUB HEAD AND GOLF CLUB

BACKGROUND

1. Field

This patent disclosure relates to a golf club head, in particular a golf putter head, with a striking face, which is provided on the front side of a striking part, for a golf ball, and with a device, which is fastened to the rear side of the striking part, for arranging interchangeable weights. The invention furthermore relates to a golf club with a head of this type.

2. Related Art

The putter is used in golf in order to hole or to putt the ball on the green. The putter usually comprises a putter head and a shaft with a grip. The individual parts of the putter are connected fixedly to one another. A shifting of mass in the putter head is achieved by the putter head itself having a small mass, and as large a mass as possible being selected from one or more additional weights. The putter head itself is therefore produced from a material with a low specific weight, preferably light metal, and a metal with a higher specific weight is used for the additional weights. The additional weights are fitted to the rear part of the putter head, on the opposite side of the putter striking face or the engagement point of the shaft.

Different variant embodiments of putter heads are known which permit different weights to be fitted in an interchangeable manner. A putter head of this type is known, for example, from US 2006/0154740 A1. In this case, a variable number of weights can be fitted in a selectable longitudinal position on two bolts arranged in parallel, in order in this manner not only to be able to change or adjust the putter weight but also the center of gravity of the putter. WO 2006/071606 A2 discloses a putter head which has a base part which is manufactured from a material with a low specific weight, for example aluminum and to which different weights can be fitted, to the part furthest away from the striking face, and therefore the center of gravity of the weight can be shifted as far away as possible from the striking face.

SUMMARY

The disclosed golf club head, in particular a putter head, is designed in such a manner that the shifting of the center of gravity and distribution of the weight of the head is possible in a more variable manner than in the case of the known systems.

The device has two elements which mutually intersect without any contact and to the free end sections of which weights can be fitted.

With this golf club head design, it is possible to shift the center of gravity of the weight of the head both away from the striking face and in the lateral direction in a simple manner. At the same time, the overall weight of the head can be varied within a wide range.

In a preferred embodiment, the elements which mutually intersect without any contact are two crossbars. A golf club head designed in such a manner is particularly insensitive to twisting if its striking face to the side of the sweet spot is hit.

The golf club head can be particularly readily balanced in terms of weight if the elements or crossbars which mutually intersect without any contact comprise, in particular, a straight central section and end sections protruding there from at obtuse angles.

According to a further feature, the elements or crossbars which mutually intersect without any contact are fastened by their other end sections to the rear side of the striking part.

This measure provides the golf club head with a compact construction and assists comfortable handling of the golf club.

The two crossbars can be arranged in a particularly simple manner without mutual height offset if each crossbar is provided with a depression in the intersecting region with the other crossbar, and therefore the two crossbars can engage one inside the other without any contact in the region of their depressions.

Further weights for balancing the golf club head or for shifting the center of gravity can easily be fitted interchangeably to the lateral ends of the striking part. The interchanging of weights of differing size is particularly simple if the weights are designed and can be fitted in the manner of screws.

Also disclosed is a golf club, in particular a golf putter, with a head designates described herein.

Other features and advantages will become apparent from the following description of embodiments, which refers to the accompanying drawings.

DESCRIPTION OF THE DRAWINGS

Further features, advantages and details of the disclosed golf club and head are described in more detail with reference to the drawings which schematically illustrate an exemplary embodiment. In the drawings.

DETAILED DESCRIPTION

Figure 1:
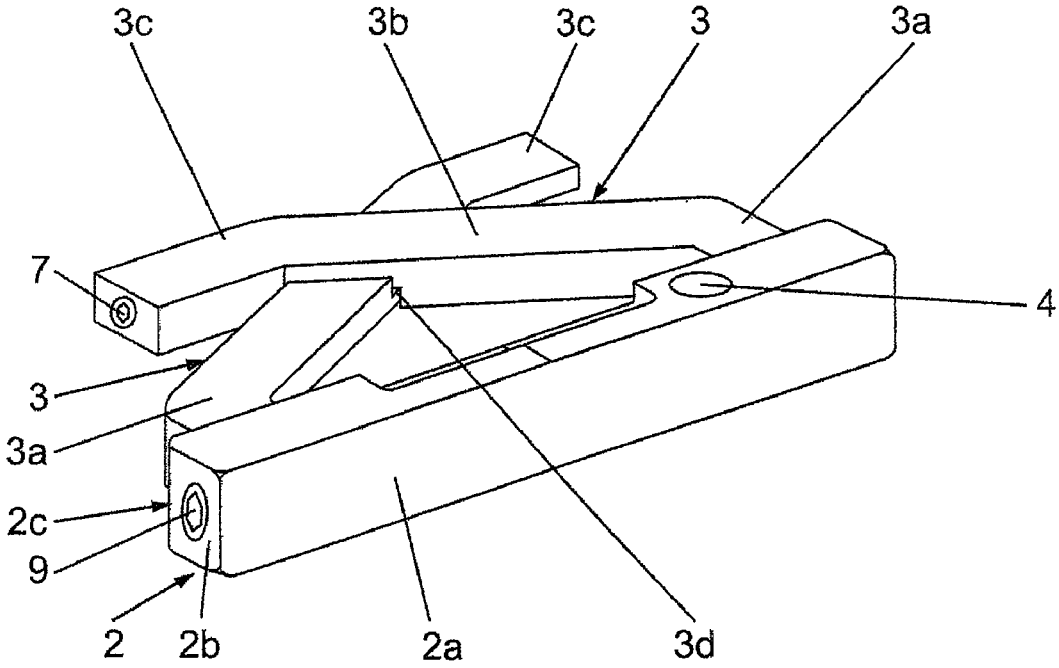
FIG. 1 shows an oblique view of an embodiment of a golf putter head.
Figure 2:
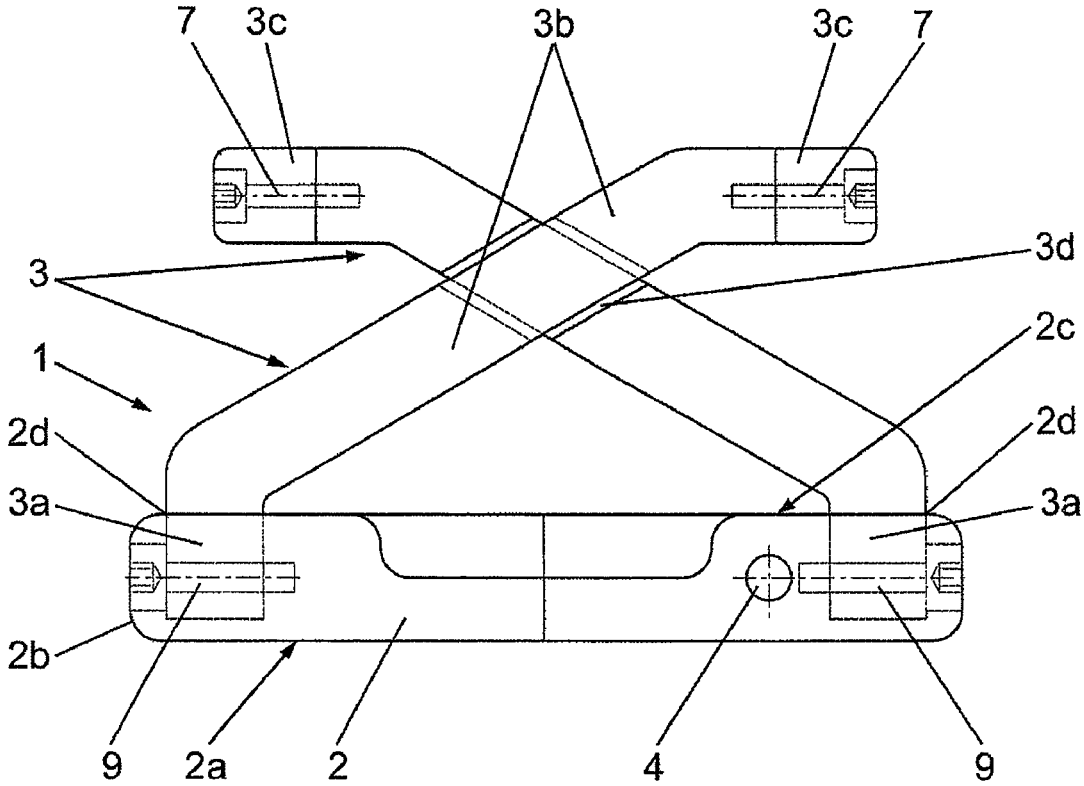
FIG. 2 shows the golf putter head from FIG. 1 in plan view.

The figures of the drawings show an exemplary embodiment of an assembled golf putter head 1 which has an elongate, plate- or bar-shaped striking part 2 with a striking face 2*a* on one longitudinal side. A bushing 4 for receiving and fastening a club shaft (not illustrated) is provided on the upper side of the striking part 2. Openings 2*d* for the insertion of short end sections 3*a* of two crossbars 3 are formed on the lateral end sections of the rear side 2*c* of the striking part 2, which side lies opposite the striking face 2*a*. The two crossbars 3, which are designed such that they correspond, have long central sections 3*b* and further short, but free end sections 3*c*. The crossbars 3 mutually intersect in the region of their central sections 3*b* which protrude from the end sections 3*a* at an obtuse angle. The free end sections 3*c* protrude from the central sections 3*b* likewise at obtuse angles and approximately parallel to the striking part 2. Each crossbar 3 has a depression 3*d* on its central section 3*b*, and therefore the two crossbars 3 can be arranged such that they intersect without a mutual height offset, with no mutual contact of the crossbars 3 taking place in the intersecting region. Weights 7 which differ in each case in heaviness can be screwed interchangeably onto the free end section 3*c* of each crossbar 3.

Weights 9 which differ in heaviness can likewise be screwed interchangeably onto the end surfaces 2*b* of the striking part 2. It is furthermore possible for the weights 9 to fasten the crossbars 3 to the striking part 2, by said weights passing through threaded holes in the end sections 3*a* of said crossbars.

The weights 7, 9 make it possible, firstly, to laterally balance the putter head 1 and, secondly, to shift the center of gravity of the putter head rearward in the direction of the free end sections 3*c* of the crossbars 3. In the case of a putter head 1 designed as described herein, the entire weight of the putter head 1 can therefore be influenced or adjusted, and the center of gravity can be shifted in the desired direction.

A further advantage of the crossbars 3 which have been crossed but arranged without any contact is the noticeable insensitivity of the putter head to twisting if its striking face is hit to the side of the sweet spot (of the center).

Another advantage of balancing the putter head is also provided in embodiments in which the two crossbars 3 are in contact or in which the crossbars are connected to each other in the intersecting region. Instead of two crossbars, a component with parts arranged in an X-shaped manner can therefore also be provided.

The crossbars 3 are preferably produced from a metallic material, in particular a titanium alloy, and preferably have a circular or square cross section. In the intersecting region, the mutual distance between the two crossbars 3 is preferably between 2 mm and 5 mm in order to avoid the crossbars 3 coming into contact during vibrations, which occur during use, of the putter head 1.

The golf club and head are not restricted to the exemplary embodiment illustrated. It is possible, in particular, to arrange the two crossbars 3 such that they intersect in another manner, for example by one passing through the other.

Although particular embodiments have been disclosed, many other variations and modifications and other uses will become apparent to those skilled in the art. Therefore, the present invention is not limited by the specific disclosure herein.

The invention claimed is:

1. A golf club head, comprising:

a striking face, which is provided on a front side of a striking part, for striking a golf ball, and a weight receiving device, which is fastened to a rear side of the striking part, opposite to the front side, for receiving interchangeable weights, wherein the weight receiving device has two elements which mutually intersect behind said rear side, each element having a proximal end section attached to the rear side of the striking part, and a free end section to which said weights can be fitted;

characterized in that the elements are two crossbars which mutually intersect at an intersection location intermediate said proximate end and said free end, without any contact between the crossbars at said intersection location; and characterized in that the crossbars which mutually intersect without any contact each comprise a straight central section and said proximal and said free end sections protruding therefrom at angles.

2. The golf club head according to claim 1, characterized in that each crossbar is provided with a depression in a region intersecting with the other crossbar, whereby the crossbars engage one inside the other without any contact in the region of their respective depressions.

3. The golf club head according to claim 1, wherein further weights can be fitted interchangeably to lateral end sections of the striking part.

4. The golf club head according to claim 3, further comprising weights that are interchangeably attachable to at least one of said weight-receiving device and said lateral end sections of the striking part.

5. A golf club, with a head according to claim 1; and a shaft fastened to said head.

6. The golf club head according to claim 1, characterized in that each crossbar is provided with a depression in a region intersecting with the other crossbar, whereby the crossbars engage one inside the other without any contact in the region of their respective depressions.

7. The golf club head according to claim 1, further comprising weights that are interchangeably attachable to said weight receiving device.

8. A golf club head, comprising:

a striking face, which is provided on a front side of a striking part, for striking a golf ball, and a weight receiving device, which is fastened to a rear side of the striking part, opposite to the front side, for receiving interchangeable weights, wherein the weight receiving device has two elements which mutually intersect behind said rear side, each element having a proximal end section attached to the rear side of the striking part, and a free end section to which said weights can be fitted;

wherein further weights can be fitted interchangeably to lateral end sections of the striking part;

characterized in that the weight-receiving device and the lateral end sections are threaded such that the weights can be fitted in the manner of screws.

9. The golf club head according to claim 8, further comprising weights for being received on at least one of said weight receiving device and said striking part.

10. A golf club, with a head according to claim 9; and a shaft fastened to said head.

11. The golf club head according to claim 9, wherein said weights are threaded for being fitted in the weight receiving device and the striking part in the manner of screws.

12. The golf club head according to claim 9, characterized in that each crossbar is provided with a depression in a region intersecting with the other crossbar, whereby the crossbars engage one inside the other without any contact in the region of their respective depressions.

13. A golf club head, comprising:

a striking face, which is provided on a front side of a striking part, for striking a golf ball, and a weight receiving device, which is fastened to a rear side of the striking part, opposite to the front side, for receiving interchangeable weights, wherein the weight receiving device has two elements which mutually intersect behind said rear side, each element having a proximal end section attached to the rear side of the striking part, and a free end section to which said weights can be fitted;

wherein further weights can be fitted interchangeably to lateral end sections of the striking part;

wherein said lateral end sections have apertures in the rear side of the striking part for receiving and securing the one ends of the two elements.

14. The golf club head according to claim 13, wherein said lateral end sections and said one ends are threaded for being secured together by a threaded weight.

* * * * *